US008573739B2

(12) United States Patent
Choy et al.

(10) Patent No.: US 8,573,739 B2
(45) Date of Patent: Nov. 5, 2013

(54) WIDE-ARRAY INKJET PRINTHEAD ASSEMBLY

(75) Inventors: Silam J. Choy, Corvallis, OR (US); Patrick V. Boyd, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/703,150

(22) PCT Filed: Aug. 19, 2010

(86) PCT No.: PCT/US2010/046014

§ 371 (c)(1),
(2), (4) Date: Dec. 10, 2012

(87) PCT Pub. No.: WO2012/023941

PCT Pub. Date: Feb. 23, 2012

(65) Prior Publication Data

US 2013/0106954 A1 May 2, 2013

(51) Int. Cl.
*B41J 2/155* (2006.01)

(52) U.S. Cl.
USPC ..... 347/42; 347/40; 347/65

(58) Field of Classification Search
USPC ..... 347/20, 40, 42–47, 49, 65–67, 70–71, 347/85

See application file for complete search history.

(56) References Cited

U.S. PATENT DOCUMENTS

| | | | | |
|---|---|---|---|---|
| 6,755,513 | B1 | 6/2004 | Silverbrook et al. | |
| 7,175,256 | B2 | 2/2007 | Silverbrook | |
| 7,175,265 | B2 | 2/2007 | Tsuyama et al. | |
| 7,416,277 | B2 | 8/2008 | Silverbrook et al. | |
| 7,441,864 | B2 | 10/2008 | Silverbrook et al. | |
| 7,669,964 | B2 | 3/2010 | Silverbrook | |
| 8,393,712 | B2 * | 3/2013 | Fang et al. | 347/42 |
| 2002/0140776 | A1 | 10/2002 | Silverbrook et al. | |
| 2007/0210031 | A1 | 9/2007 | Clarke et al. | |
| 2008/0170109 | A1 | 7/2008 | Lee et al. | |
| 2008/0174636 | A1 | 7/2008 | Kim et al. | |
| 2009/0141093 | A1 | 6/2009 | Lee et al. | |

FOREIGN PATENT DOCUMENTS

| | | |
|---|---|---|
| KR | 20080114349 | 12/2008 |

* cited by examiner

*Primary Examiner* — Thinh Nguyen

(57) ABSTRACT

A wide-array inkjet printhead assembly with die carriers includes a backbone which delivers fluid through a manifold with a number of openings. The openings are spaced apart according to a opening pitch. A plurality of inkjet die includes trenches with a trench pitch which is smaller than the opening pitch. A plurality of die carriers include a plurality of oblique tapered channels, with one end of the oblique tapered channels having pitch matching the opening pitch and interfacing with the backbone and the opposite end of the oblique tapered channels having a pitch matching the trench pitch and interfacing with the inkjet die. A method for assembling a wide-array inkjet printhead assembly is also described.

15 Claims, 6 Drawing Sheets

WIDE-ARRAY INKJET PRINTHEAD ASSEMBLY

BACKGROUND

Wide-array inkjet printhead assemblies typically deposit ink across the width of a substrate as it is fed through the printer. Because the wide-array printheads are substantially as wide as the substrate, there is no need for translation of the printhead. However, the increased size of the wide-array inkjet printhead assembly can also increase the number of components, increase the cost of the printhead, and lead to more stringent manufacturing tolerances.

BRIEF DESCRIPTION OF THE DRAWINGS

The accompanying drawings illustrate various embodiments of the principles described herein and are a part of the specification. The illustrated embodiments are merely examples and do not limit the scope of the claims.

Throughout the drawings, identical reference numbers designate similar, but not necessarily identical, elements.

DETAILED DESCRIPTION

Wide-array inkjet printhead assemblies typically deposit printing fluid across the width of a substrate as it is fed through the printer. Because the wide-array printheads are substantially as wide as the substrate, there is no need for translation of the printhead. However, the increased size of the wide-array inkjet printhead assembly can also increase the number of components, increase the cost of the printhead, and lead to more stringent manufacturing tolerances.

According to one illustrative embodiment, a wide-array inkjet printhead assembly is composed of an array of printhead die. These printhead die are among highest precision components in the printhead assembly and contain the ink droplet ejection mechanisms. For example, the printhead die may contain thermal, piezo, or MEMs ejection elements. These ejection elements are activated to force droplets of fluid out of an array of nozzles. These droplets may have a volume on the order of 1-30 picoliters. The droplets may take the form of ink droplets are deposited on a substrate to create the desired image.

The remainder of the printhead assembly supports this droplet ejection functionality of the printhead die. For example, a printhead assembly structurally supports the printhead die, provides electrical connections to each printhead die, and routes ink to each nozzle in each printhead die.

In one embodiment, each printhead die is packaged with an individual die carrier before mounting the resulting modules to the manifold assembly. The die carriers act as physical and fluidic interface between the manifold assembly and the inkjet die. The use of die carriers allows for modularity in constructing the printhead and allows the manifold to be formed with larger, less precise features. Consequently, the manifold can be formed using low cost materials and methods of fabrication. This can result in a significant reduction in the cost to produce the manifold, while maintaining or improving the printing performance of the printhead.

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an embodiment," "an example" or similar language means that a particular feature, structure, or characteristic described in connection with the embodiment or example is included in at least that one embodiment, but not necessarily in other embodiments. The various instances of the phrase "in one embodiment" or similar phrases in various places in the specification are not necessarily all referring to the same embodiment.

Figure 1:
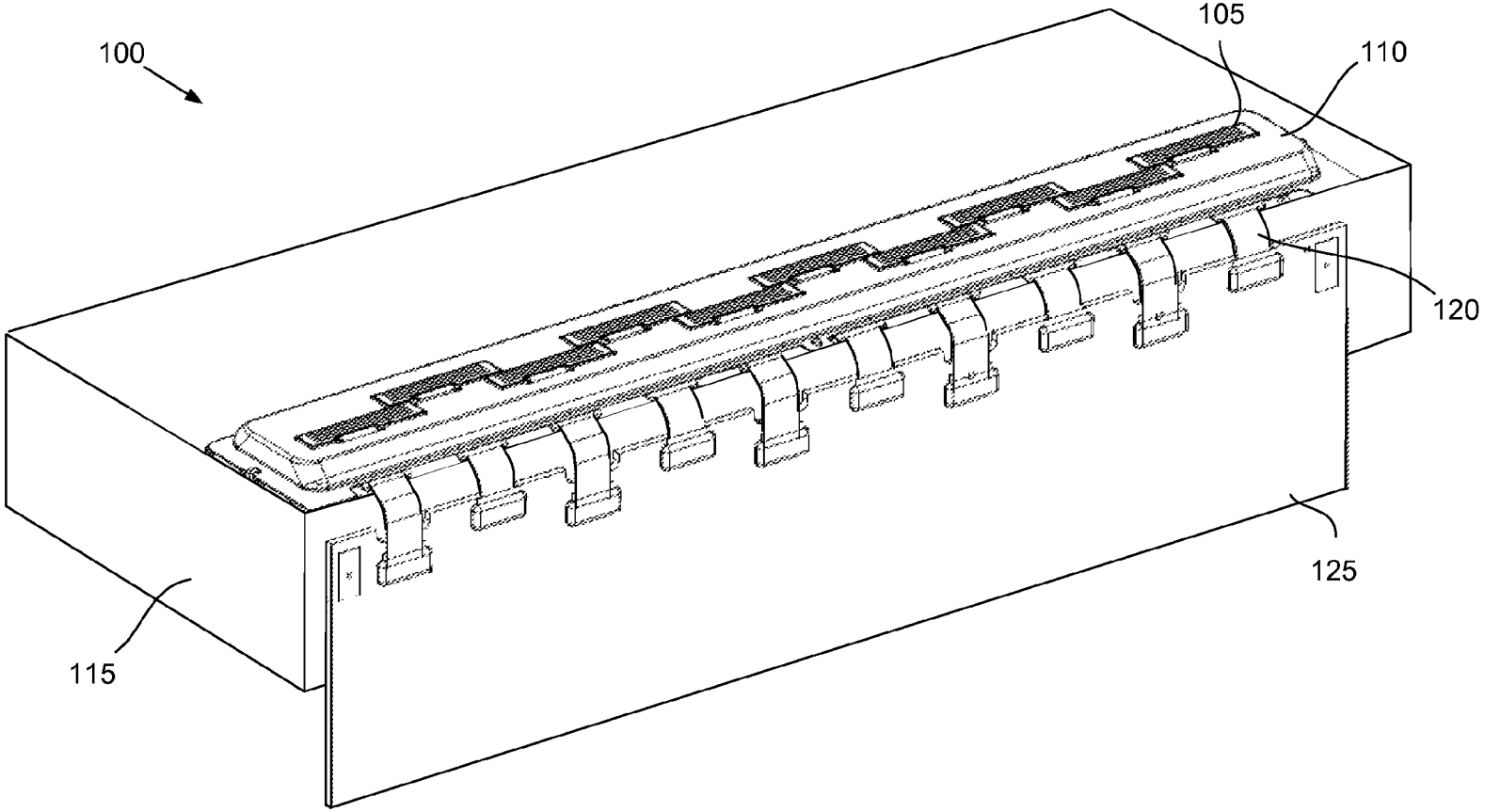
FIG. 1 is a perspective view of an illustrative wide-array inkjet printhead assembly, according to one embodiment of principles described herein.

FIG. 1 is a perspective view of an illustrative wide-array inkjet printhead assembly (100). The printhead (100) includes a backbone (115), a plurality of inkjet die (105), a shroud (110), a circuit board (125) and flex cables (125) which electrically connect to the die (105) to the circuit board (125). The backbone (115) structurally supports the printhead die (105) and routes ink or any other suitable fluid to each of the printhead die (105). A manifold structure within the backbone (115) accepts ink from an ink reservoir and distributes the ink to the individual die (105). The shroud (110) attaches to the backbone (115) and encloses the die assemblies to provide a sealing surface for a cap which is placed over the die (105) when they are not in use. The shroud (110) and cap prevent the die (105) from drying out and subsequently malfunctioning. The shroud (110) may be formed from a number of materials using a variety processes. According to one illustrative embodiment, the shroud (110) is formed from stainless steel using sheet metal techniques.

The circuit board (125) electrically controls the individual firing mechanisms within the die (105) so that the appropriate color, amount, and pattern of ink is ejected from the die (105) to create the desired image on a substrate. The circuit board (125) is connected to the die (105) by flex cables (120). Flex cables (120) contain a number of parallel conductors which are sandwiched between two flexible sheets. Typically, the flexible sheets are a plastic such as polyimide, polyester or PEEK films. The shroud (110), flex cables (120), electrical connections at the ends of the flex cables (120), circuit board (125), and sealing the perimeter of the shroud (110) over the electrical connections are discussed in U.S. patent application Ser. No. 13/703,171 entitled "Wide-Array Inkjet Printhead Assembly with a Shroud," attorney docket number 201000617, to Silam J. Choy, filed Aug. 19, 2010, which is hereby incorporated by reference in its entirety.

The inkjet die (105) are among the highest precision parts in the printhead assembly (100) and represent a significant portion of the cost of the printhead (100). In a thermal inkjet system, the die (105) are typically manufactured from silicon using lithographic or other techniques to produce firing chambers which are arranged in a trench along the length of the die (105). The firing chambers include a cavity, a resistive heater adjacent to the cavity, and a nozzle. The ink or any other suitable fluid is fed into the trench and enters the cavities of the firing chambers. To eject an ink droplet, an electrical current is passed through the flex cable (120) to the resistive heater. The heater rapidly heats to a temperature above the boiling point of the ink. This creates a localized vapor bubble in the ink filled cavity and sharply increases the pressure within the cavity. This ejects an ink droplet from the nozzle. After the current is removed, the heater rapidly cools and the vapor bubble collapses, thereby drawing more liquid into the cavity from the trench. For purposes of illustration, the geometry of the die (105) has been simplified in the figures. The die (105) are illustrated as having four parallel trenches which run along a substantial length of the die (105), with each trench being dedicated to a specific ink color. For example, each die (105) may dispense magenta, cyan, yellow and black ink. The die are arranged in a staggered configuration so that trenches from the die (105) are able to dispense ink of each color across substantially the entire width of a substrate which passes under the printhead (100).

To ensure high print quality, the array of inkjet die (105) should be tightly aligned in all six degrees of motion. For example, all the printheads (100) may be coplanar to within 100 to 200 microns to ensure that the nozzle to media distance is substantially similar. This improves drop placement as the media is continuously advanced under the printhead. The larger the variation in nozzle to media distance, the larger the dot placement error.

In most embodiments, the printhead (100) would be a least as long as the media size. For example for A4 media, the staggered die (105) array would be at least 210 millimeters long and possibly longer. Additionally, for print quality, the printhead (100) should deliver ink to the die (105) with a relatively uniform pressure. This helps to ensure that the ink droplets delivered by the inkjet die (105) are uniform.

Figure 2:
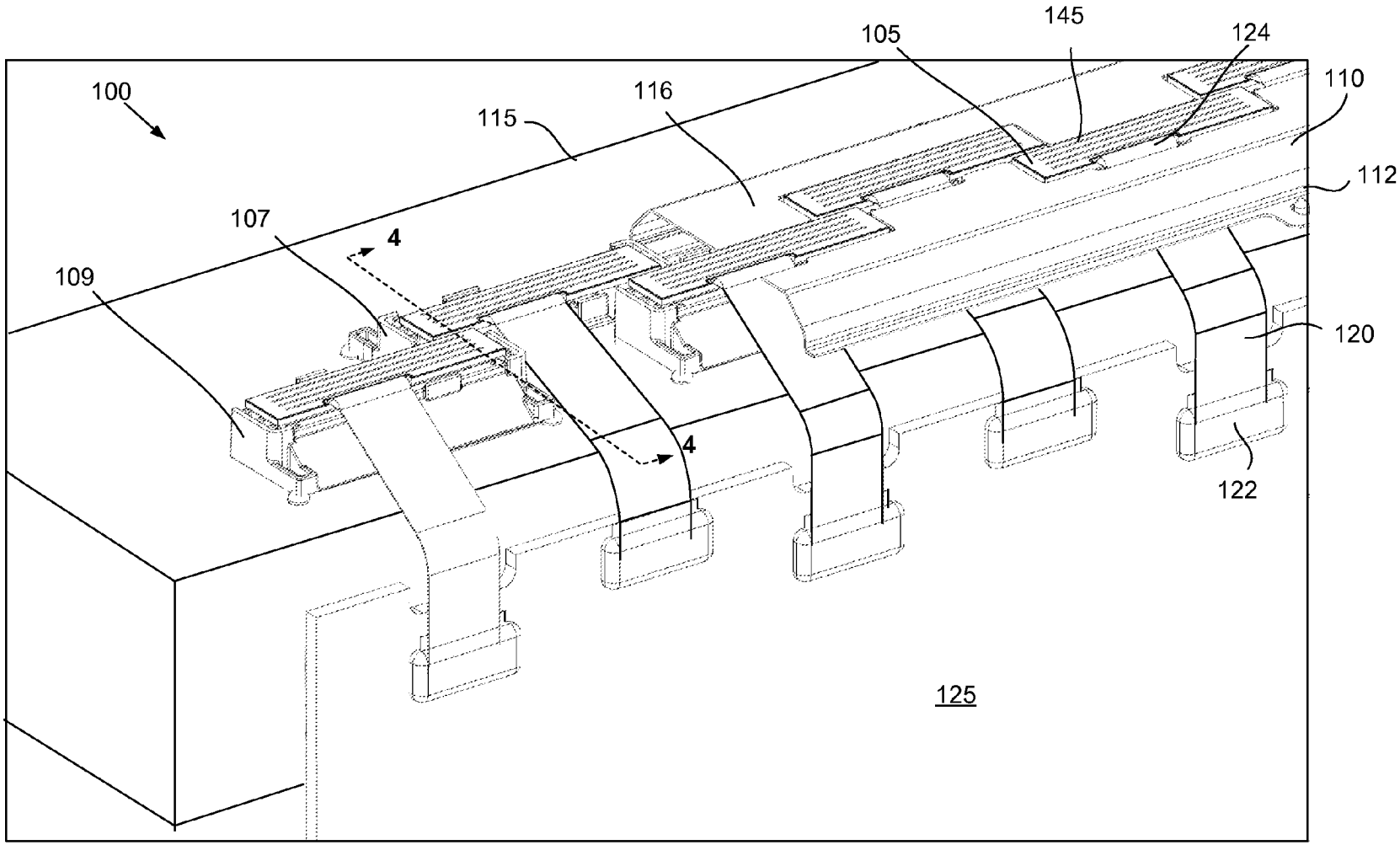
FIG. 2 is a partially cutaway view of an illustrative wide-array inkjet printhead assembly, according to one embodiment of principles described herein.

FIG. 2 is a partially cutaway view of an illustrative wide-array inkjet printhead assembly (100). In this view the shroud (110) has been partially cutaway to show the underlying die carriers (107, 109) and other aspects of the printhead (100). In one embodiment, both the left and right die carriers (107, 109) are identical, but oriented in different directions. Because the die carriers (107, 109) are identical, only a single die carrier design needs to be manufactured. The higher volume production results in lower costs per part.

As discussed above, a flex cable (120) connects each die carrier (107, 109) to the circuit board (125). The first end of the flex cable (120) makes a first connection with the circuit board (125), which is labeled in FIG. 2 as the board connection (122). The other end of the flex cable (120) makes a second connection with the contact pads on the die (105) which is labeled in FIG. 2 as the die connection (124). These connections (122, 124) may be made in a variety of ways. One design aspect of the die connection (124) is that the die connection (124) and the flex cable (120) as it leaves the die connection (124) should not interfere with the fit of the shroud (110).

The shroud (110) includes a perimeter flange (112) which is sealed to the backbone (115). The shroud (110) serves at least three functions. First, the shroud (110) protects the underlying components from damage and contamination. Second, the shroud (110) provides a planar surface (116) which is at approximately the same level as the top of the die (105). This planar surface (116) supports a wiper which passes over and cleans the die (105). Third, the shroud (110) provides a uniform sealing surface for a cap which covers the die (105) when the printer is not in use. Covering the die (105) with the cap can prevent the evaporation of solvent from the ink. When the solvent evaporates, the ink solids are left behind. These ink solids can accumulate and cause a number of issues including blocked nozzles and misdirected ink droplets. The cap seals onto the shroud (110) to enclose the die (105) in a sealed cavity. As ink begins to evaporate from the die (105), the humidity in the sealed cavity increases and prevents further evaporation.

Figure 4:
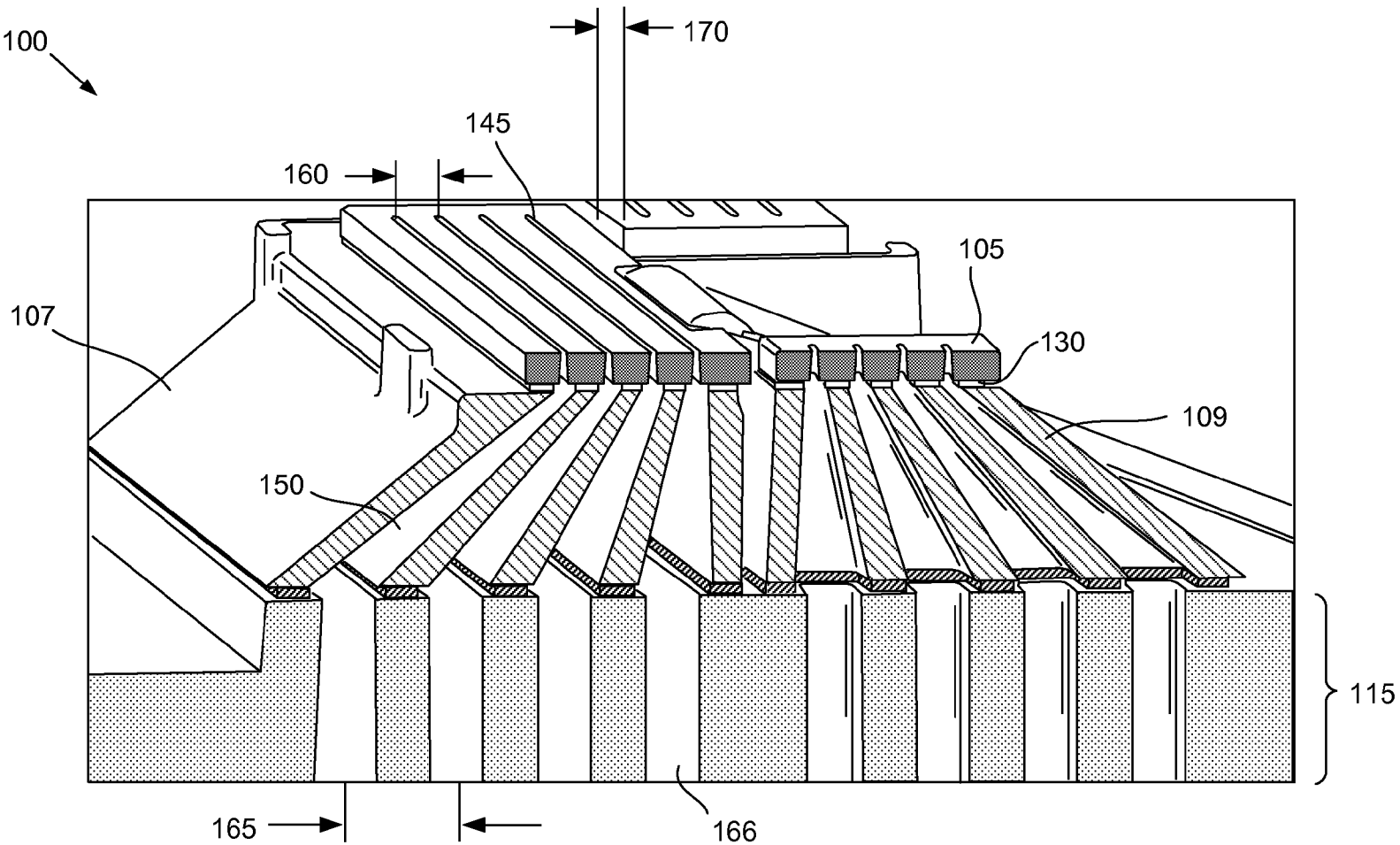
FIG. 4 is a cross sectional view of an illustrative wide-array inkjet printhead assembly, according to one embodiment of principles described herein.

The dashed line labeled 4-4 indicates the location and viewing direction of FIG. 4. As discussed below, FIG. 4 shows the interior of manifold openings in the backbone (115) and ink channels in the die carriers (107, 109).

Figure 3A:
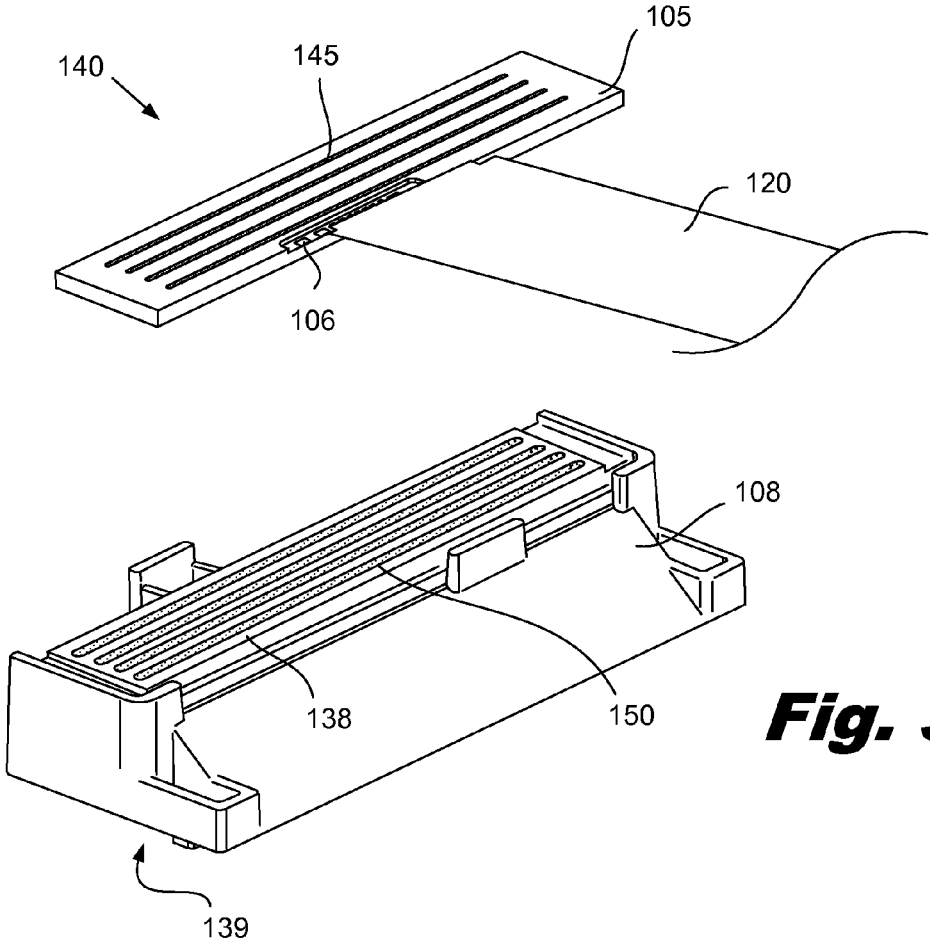
FIG. 3A is an exploded view of an illustrative die assembly which includes a die carrier, according to one embodiment of principles described herein.

FIG. 3A is an exploded view of an illustrative die assembly (140) which includes a die carrier (108), die (105), and flex cable (120). As discussed above, the lower surface of the die carrier (108) is sealed over manifold openings in the backbone (115, FIG. 2). Oblique tapered channels (150) in the die carrier (108) direct fluid from the lower surface (139) to the upper surface (138) of the die carrier (108). At the upper surface (138) of the die carrier (108) the oblique tapered channels (150) have approximately the same pitch and length as the trenches (145) in the die (105). Thus the oblique tapered channels (150) direct ink from the manifold openings in the backbone (115, FIG. 2) through the die carrier (108) and into the trenches (145).

Because the die carrier (108) is similar in length to the die (105), the die carrier (108) can be molded flat enough to allow the die (105) to be bonded to the die carrier (108) without requiring costly secondary operations. For example, if a 25 millimeter long die requires an upper surface flatness of 0.1 millimeter, the flatness specification is 0.4% of the die carrier length. This is within the capability of precision thermoplastic injection molding without any secondary operations.

The flex cable (120) is attached to the die contacts (106). According to one embodiment, the electrical conductors in the flex cable (120) are copper ribbons or wires, which are covered with gold. These copper ribbons extend beyond the sandwiching polymer films. In one example, the copper ribbons are attached to the gold plated die contacts (106) using Tape Automated Bonding (TAB). After making the electrical connections, a number of additional operations can be performed to ensure that the connection is electrically/mechanically secure and that the flex cable (120) exits the connection at the desired angle. For example, the connection may be encapsulated with a curable polymer (i.e. "glob topping"). In some embodiments, a small amount of curable polymer may be deposited under the flex cable (120) and adhere to the underside of the flex cable (120) to the die (105) and/or die carrier (108). An additional quantity of curable polymer is then deposited on top of the connection.

Figure 3B:
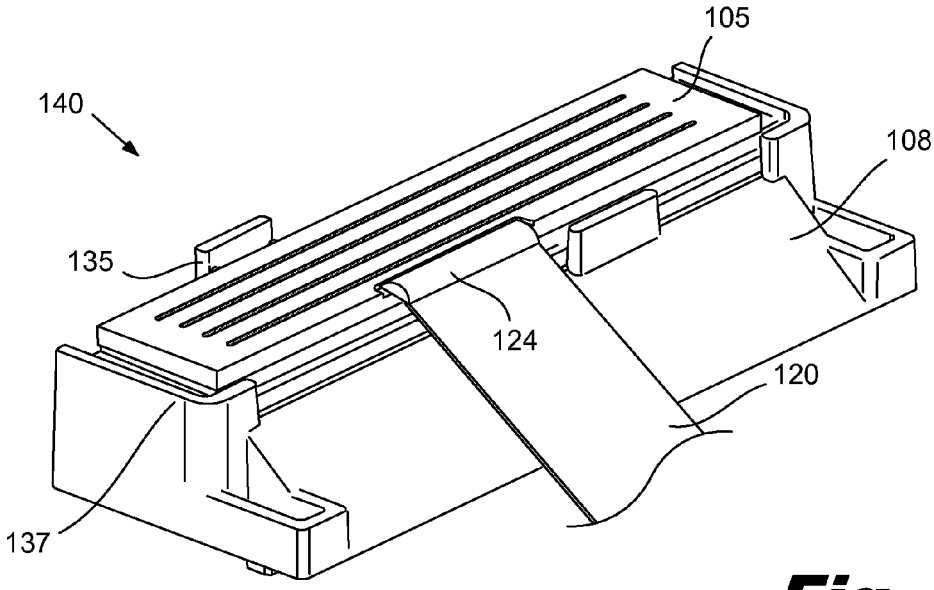
FIG. 3B is a perspective view of an illustrative die assembly which includes a die carrier, according to one embodiment of principles described herein.

FIG. 3B is a perspective view of a die assembly (140). The die assembly (140) includes the die (105), the die carrier (108), the flex cable (120) and the die connection (124). The die assembly (140) is a modular unit which can be independently tested to verify its functionality. For example, the die assembly (140) can be electrically tested to verify that the flex cable (120) makes a proper electrical connection with the die (105) through the die connection (124). The electrical test may also include checking electrical functions of the die (105). For example, the resistance of the various heater elements in the die (105) can be measured by attaching appropriate testing equipment to the opposite end of the flex cable (120).

The embodiment of the die assembly (140) shown in FIG. 3B has a right facing die carrier (108). To form a die assembly (140) with a left facing die carrier (108), the die carrier (108)

is rotated 180 degree prior to adhering the die (105) to the upper surface (138, FIG. 3A) of the die carrier (108). However, the die (105) and flex cable (120) orientation remains the same. This allows the flex cables (120) on both the right and left facing die carriers (108) to come off the same side and simplifies their connection to a single circuit board (125, FIG. 2).

The die carriers (108) include a number of features which are configured to interface with and support the shroud (110, FIG. 2). In this example, the support features include posts (135) on either side of the die (105) and corners (137) at either end of the die carrier (108). The upper surfaces of these support features (135, 137) are formed in a common plane. When the shroud (110, FIG. 2) is put in place, the support features (135, 137) make contact with the under surface of the shroud (110, FIG. 2). This provides additional support for the center of the shroud (110, FIG. 2).

FIG. 4 is a cross sectional view of an illustrative wide-array inkjet printhead assembly along line 4-4 shown in FIG. 2. In this embodiment, cross sections are taken of two back-to-back die carriers: a left facing die carrier (107) and a right facing die carrier (109). As discussed above, the backbone (115) provides structural support for the die carriers (107, 109) and contains manifold openings (166). The manifold openings (166) have a opening pitch (165) which is significantly greater than the trench pitch (160) of the die (105). According to one illustrative embodiment, the opening pitch (165) is greater than 2 millimeters and the trench pitch (160) is less than 1.5 millimeters. For example, the opening pitch (165) may be approximately 3 millimeters and the trench pitch (160) may be approximately 1 millimeter.

The size of the die (105) is a significant factor in the overall cost of the printhead (100). As discussed above, the die (105) can be formed from a silicon wafer using lithography techniques. It is conceivable that a single inkjet die (105) could be created which would span the width of the printhead (100) and substrate. For a number of reasons this approach may be more expensive and result in a printhead which is less robust than a printhead which uses an array of smaller die. For example, the single large die would be more expensive to produce than the equivalent number of smaller die, may have tighter manufacturing tolerances, and may be more likely to have a fatal manufacturing error which would result in the larger die being scrapped. Further, in operation, the larger die may be significantly more fragile due to its small cross section and greater length. Additionally, the thermal mismatch between the larger die and the supporting material may be exacerbated by the length. Consequently, there are significant cost and engineering benefits to reducing the size of the inkjet die.

In addition to manufacturing the die (105) with a shorter length, the width of the die (105) can be minimized by reducing the distance between the trenches (145). For example, the trench pitch (160) can be reduced to less than 1 millimeter without detriment to the operation of the firing chambers. By reducing the width of the die (105), more die (105) can be manufactured from a single silicon wafer, resulting in a reduced cost per die.

However, supplying ink to die with more closely spaced trenches can be challenging. Specifically, manufacturing a backbone which spans the length of printhead and also contains manifold openings which are spaced less than a millimeter apart is challenging. Plastic injection molding, which is a low cost, high volume production method, cannot reliably produce a backbone with manifold openings with less than a millimeter pitch. A variety of other more expensive approaches could be used. For example, the backbone could be machined from metal. However, machining the backbone results in manufacturing costs which are two or three orders of magnitude greater than injection molding.

The use of a die carrier (107, 109) with oblique tapered slots (150) resolves this challenge by allowing the manifold opening pitch (165) to remain relatively large, while permitting the die trench pitch (160) to be reduced. The backbone (115) can still be designed and manufactured as an inexpensive injection molded part and the die width can be reduced to lower the cost of the die (105). As discussed above, the oblique tapered channels (150) act as fluidic interfaces between the manifold openings (166) and the die trenches (145).

Additionally the oblique nature of the channels (150) in the die carriers (107, 109) allows the back-to-back distance (170) between the die (105) to be minimized. Each of the tapered channels (150) are arranged at a different angle to transition between the manifold opening pitch (e.g. 2.5 millimeter) and the die trench pitch (e.g. <1 millimeter). In the center of the staggered row, the oblique tapered channels of the die carriers (107, 109) are substantially vertical. This allows the die (105) to be located to one side of the die carrier such the back-to-back distance (170) between the die (105) on the left facing and right facing die carriers (107, 109) is minimized. Minimizing the back-to-back distance between the die (105) can significantly reduce printing errors. For example, a number of factors which directly influence printing quality, such as timing and droplet flight distances, influenced by the back-to-back distance (170) between the die (105). Specifically, the greater the lateral distance between the die (107, 109), the greater the variability in the substrate distance and droplet flight distances. Other factors, such as ejection timing, are also influenced by the back-to-back distance (170) between the die (105).

Figure 5B:
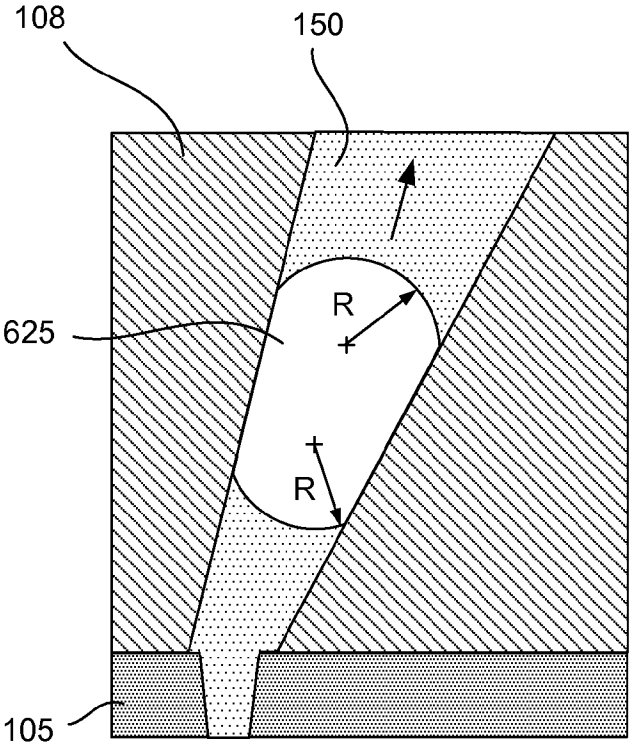
FIGS. 5A and 5B are cross sectional views of bubbles in illustrative slots which feed inkjet die, according to one embodiment of principles described herein.
Figure 5A:
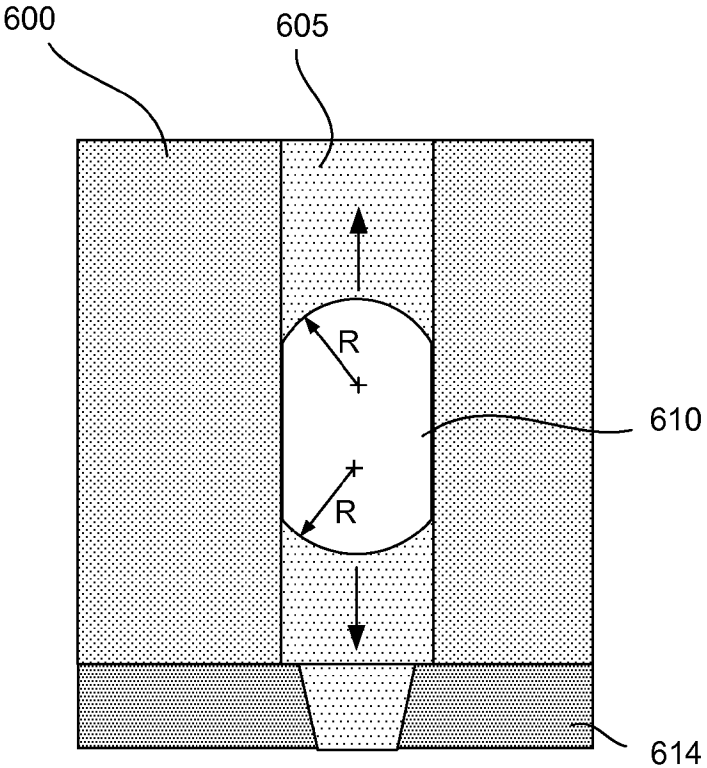

FIGS. 5A and 5B are cross sectional views of a small portion of two different die and their ink delivery system. The die are located at the bottom of the figures and the ink is delivered to the die through slot/channels from the top of the figures. In general, inkjet die can operate in any orientation, but typically the droplets are ejected downward from a die onto an underlying substrate.

FIG. 5A is a cross sectional diagram of a bubble (610) trapped in a straight sided manifold slot (605). Bubbles (610) can form in the slots (605) and channels which feed the inkjet die (614) for a variety of reasons. For example, the bubble (610) may have been entrained in the ink and carried by the ink into the slot. Additionally, the bubble (610) may have entered through the nozzle. However, one of the more common reasons that bubbles (610) form in ink is related to a change in temperature of the ink. Ink, like most fluids, has a temperature dependent capacity to contain dissolved gasses. Colder ink can contain more dissolved gas than warmer ink. As the ink passes through the manifold, it can become warmer by absorbing heat generated by the operation of the thermal inkjets. The warmer ink no longer has the capacity to contain all of the dissolved gas. Consequently, the gas comes out of the ink as bubbles (610). These bubbles (610) can grow over time and eventually obstruct the slot (605), which causes pressure differences at the firing chambers and results in image degradation. The bubbles (610) can also migrate into the firing chambers, potentially causing malfunction and damage. Consequently, it is desirable to prevent the bubbles (610) from lodging near the die (614) and to provide a mechanism to manage the bubbles (610) which do occur.

In the embodiment shown in FIG. 5A, the bubble (610) is lodged in the slot (605) and contacts both walls of the slot. As the width of the slot (605) decreases, bubbles (610) are more likely to fill the slot (605) and stick to the side walls. The radius "R" of the bubble (610) is determined by the pressure differential across the bubble wall. The bubble (610) tends to grow in the direction which will allow the largest bubble radius. This is also the direction of least resistance for the bubble (610) to travel. Because the bubble (610) is trapped in a slot (605) with parallel sides, the bubble (610) will tend to grow in the direction of the die (614) and farther into the backbone (600) as shown by the arrows. This is undesirable because the bubble (610) remains trapped in the slot (605) and has a tendency to grow in both upward and downward. Additionally during printing, fluid would travel down to the die, potentially pushing the bubble towards the die. As discussed above, when the bubble (610) grows it will have a tendency to obstruct ink flow and interfere with the function of the firing chambers in the die (614).

FIG. 5B is a cross sectional diagram of a die carrier (108) which includes an oblique tapered channel (155). A bubble (625) is inside the oblique tapered channel (155). Unlike the slot (605, FIG. 5A), the tapered channel (155) has nonparallel walls. The bubble (625) has a tendency to grow in the direction of least resistance, which is toward the larger end of the tapered channel (155) and away from the die (105). As the bubble grows, it can escape by progressively moving up the tapered channel (155) and into a plenum or other passageway in the backbone. Once the bubble (625) is away from the die (105) and exits the die carrier (108) it can be extracted from the ink stream.

Figure 6:
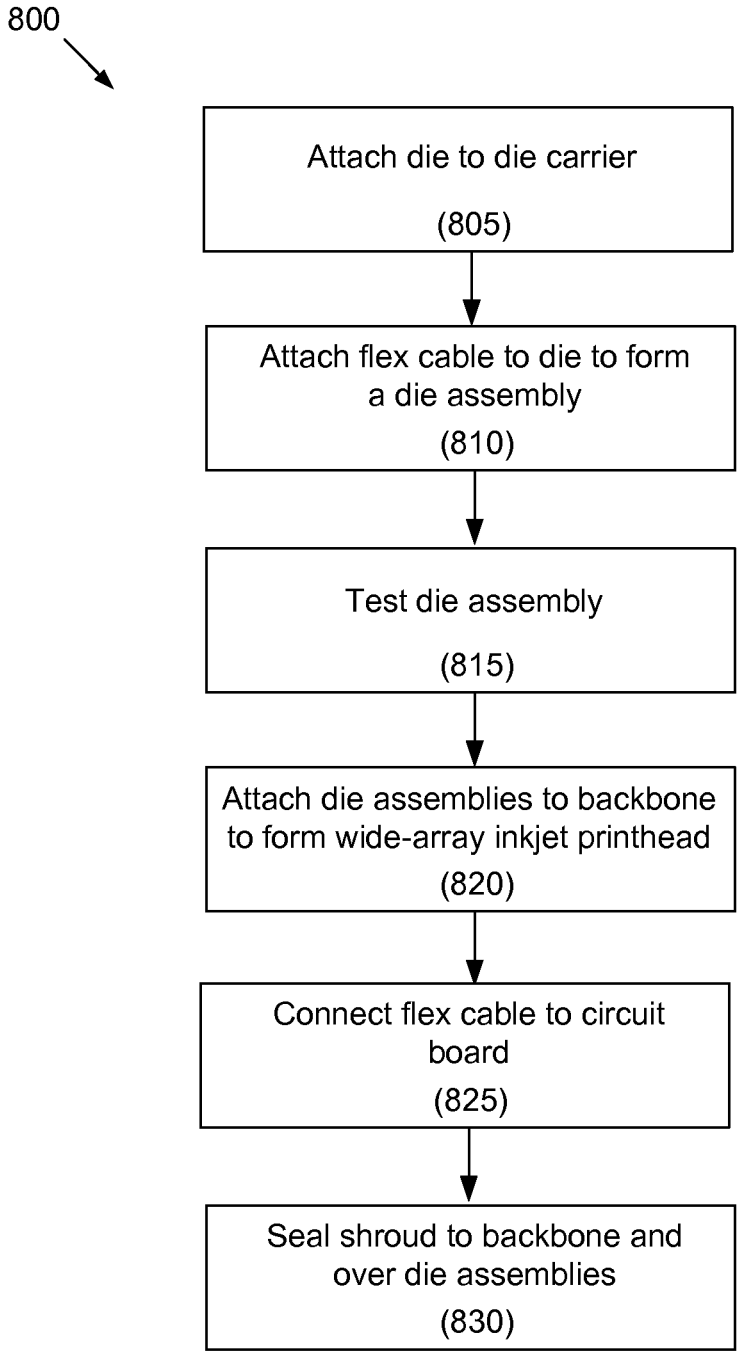
FIG. 6 is a flowchart of an illustrative method for assembling a wide-array inkjet printhead assembly, according to one embodiment of principles described herein.

FIG. 6 is a flowchart of an illustrative method for assembling a wide-array inkjet printhead assembly. The method includes attaching the die to a die carrier (805) such that trenches on the die are in fluidic communication with oblique tapered slots which extend through the die carrier. The flex cable is attached to the die to form a die assembly (810). The die assembly can be either right handed or left handed depending on the orientation of the die carrier. The die assembly is a modular component which can be separately tested to verify its function (815). For example, the die assembly may be electrically and/or fluidically tested prior to incorporation of the die assembly into a wide-array printhead.

A plurality of die assemblies is attached to a backbone in back-to-back staggered configuration (820). The die assemblies extend across a substantial portion of the length of the backbone and flex cables for each die assembly extend to one side of the printhead to facilitate making electrical connections to a single circuit board using minimum length flex cables. The flex cables are attached to the circuit board (825) and a shroud is sealed over the die assemblies (830) with the upper surfaces of the die extending out of apertures in the shroud. As discussed above, the shroud provides a continuous capping surface around the printheads and protects the flex circuits from wiping operations. Support posts and other features on the die carriers support the shroud from wiping and capping forces and position the shroud height relative to the die.

The descriptions and examples given above are only illustrative. Although plastic and injection molding are described, many different material and processes could be used. For example, filled polymers, metals, ceramics and other materials could be shaped into the various components of the printhead. Possible fabrication methods include injection molding, machining, laser machining, laminating and other techniques. Additionally, steps may be added, omitted, or reordered. For example, in some embodiments, the flex cable may be attached to the die prior to attaching the die to the die carrier. Additional steps of encapsulating the flex cable connections can be added. A variety of other steps could be also be added.

In conclusion, the specification and figures describe a wide-array inkjet printhead assembly which incorporates die carriers. The die carriers support the die and provide a mechanical and fluidic interface between the manifold openings in the backbone. The die carriers contain oblique tapered slots which adapt the pitch of the manifold openings to the pitch of the trenches on the die. The die carriers also allow the distances between the die to be minimized by placing the die carriers in a staggered back-to-back configuration. The die carriers provide additional advantages, including but not limited to, compensating for irregularities in the flatness of the backbone and guiding bubbles in the ink away from the die.

The preceding description has been presented only to illustrate and describe embodiments and examples of the principles described. This description is not intended to be exhaustive or to limit these principles to any precise form disclosed. Many modifications and variations are possible in light of the above teaching.

What is claimed is:

1. A wide-array inkjet printhead assembly comprising:

a backbone including a manifold for delivery of fluid through a number of openings, the openings having a opening pitch;

a plurality of inkjet die, the inkjet die comprising trenches with a trench pitch which is smaller than the opening pitch; and a plurality of die carriers, the die carriers comprising a plurality of oblique tapered channels, one end of the oblique tapered channels having a pitch matching the opening pitch and interfacing with the backbone and the opposite end of the oblique tapered channels having a pitch matching the trench pitch and interfacing with the inkjet die.

2. The assembly of claim 1, in which the die carriers have a substantially vertical channel on a first side and an angled channel on an opposite side.

3. The assembly of claim 1, in which the die carriers are staggered back-to-back across the length of the inkjet printhead, with a portion of the die carriers being oriented to the left and a portion of the die carriers being oriented to the right.

4. The assembly of claim 3, in which inkjet die all are placed on the die carriers in the wide-array inkjet printhead assembly with the same orientation.

5. The assembly of claim 1, in which the inkjet die are connected to die carriers to form a die assembly and the die assembly is connected to the backbone.

6. The assembly of claim 1, in which the oblique tapered channels extend a distance that the ink flows to the inkjet die.

7. The assembly of claim 1, in which the die carriers further comprise a plurality of support features for supporting a shroud.

8. The assembly of claim 7, in which the support features comprise a first post on a first side of the die carrier and a second post on a second side of the die carrier.

9. The assembly of claim 7, in which a die connection comprises a bend in conductors that extend from a flex cable to contacts on the inkjet die such that the flex cable is disposed below the plurality of support features on the die carriers.

10. The assembly of claim 1, in which both the die carriers and the backbone are formed from injection molded thermoplastic.

11. The assembly of claim 1, in which the opening pitch is greater than 2 millimeters and the trench pitch is less than 1.5 millimeters.

12. A die carrier comprising:

a first planar surface;

a second planar surface;

a plurality of oblique tapered channels extending through the die carrier from the first planar surface to the second planar surface, the oblique tapered channels having a first pitch at the first planar surface and a second smaller pitch at the second planar surface, the first planar surface interfacing with manifold openings in a backbone of a printhead assembly and the second planar surface interfacing with trenches in an inkjet die.

13. The die carrier of claim 12, further comprising a plurality of support features for supporting a shroud, the plurality of support features comprising a first post on a first side of the die carrier and a second post on a second side of the die carrier.

14. The die carrier of claim 12, in which the first pitch is greater than 2 millimeters and matches a opening pitch of fluidic channels in an underlying backbone and the second smaller pitch is less than 1.5 millimeters and matches a trench pitch of the inkjet die.

15. A method for assembling a wide-array inkjet printhead assembly comprises:

attaching a inkjet die to a die carrier such that trenches on the inkjet die are in fluidic communication with oblique tapered channels which extend through the die carrier;

attaching a flex cable to the die carrier to form a die assembly;

attaching a plurality of the die assemblies to a backbone in back-to-back staggered configuration, such that the die assemblies extend across a substantial portion of the backbone and flex cables for each die assembly extend to one side of the printhead;

in which the oblique tapered channels in the plurality of die assemblies are in fluidic communication with manifold openings in the backbone.

* * * * *